US009872563B2

(12) United States Patent
Davis

(10) Patent No.: US 9,872,563 B2
(45) Date of Patent: Jan. 23, 2018

(54) PUSH-TO-OPEN, SOFT CLOSE DRAWER SLIDE APPARATUS AND METHOD OF USE

(71) Applicant: Hardware Resources, Inc., Bossier City, LA (US)

(72) Inventor: Greg Davis, Dallas, TX (US)

(73) Assignee: Hardware Resources, Inc., Bossier City, LA (US)

( * ) Notice: Subject to any disclaimer, the term of this patent is extended or adjusted under 35 U.S.C. 154(b) by 0 days.

(21) Appl. No.: 15/081,636

(22) Filed: Mar. 25, 2016

(65) Prior Publication Data

US 2017/0273456 A1 Sep. 28, 2017

(51) Int. Cl.
*A47B 88/04* (2006.01)
*A47B 88/47* (2017.01)

(52) U.S. Cl.
CPC ..... *A47B 88/0477* (2013.01); *A47B 88/47* (2017.01); *A47B 2210/0094* (2013.01)

(58) Field of Classification Search
CPC ..... A47B 88/47; A47B 88/427; A47B 88/463; A47B 88/467; A47B 88/477; A47B 88/95
USPC ..... 312/330.1, 334.4, 334.7, 334.8, 334.6, 312/334.44, 334.46, 319.1, 348.4
See application file for complete search history.

(56) References Cited

U.S. PATENT DOCUMENTS 4,291,929 A * 9/1981 Faust ..... A47B 88/43 312/311
6,752,478 B1 6/2004 Francz
6,848,759 B2 2/2005 Doornbos et al.
6,854,817 B1 2/2005 Simon
6,932,200 B2 8/2005 Booker et al.
6,945,618 B2 9/2005 Kim et al.
7,374,261 B1 * 5/2008 Wang ..... A47B 88/463 312/319.1
7,533,946 B2 5/2009 Hoffman
7,695,080 B2 * 4/2010 Chen ..... A47B 88/427 312/333
7,802,856 B2 9/2010 Hashemi et al.
7,845,744 B2 12/2010 Chen et al.
(Continued)

OTHER PUBLICATIONS

"China Hot Selling Furniture Soft Close Push Open Drawer Slides," Alibaba, alibaba.com, Supplier: Beijing G.H.X Slide Hardware Products Tech Co., Ltd., http://www.alibaba.com/product-detail/China-Hot-Selling-Furniture-Soft-Close_60260970789.html, Accessed: Jun. 2015, 10 pages.
(Continued)

*Primary Examiner* — James O Hansen
(74) *Attorney, Agent, or Firm* — Schultz & Associates, P.C.

(57) ABSTRACT

A drawer slide apparatus mounted to a drawer slide assembly for moving a drawer slidingly within a cabinet provides push-to-open and soft close functionality while further providing a depth and alignment adjustment of the drawer relative to the cabinet carcass. The apparatus comprises a housing including a soft close track, a damper, and a carriage slidable within the soft close track. A guide block comprising a set of channels within a stationary part and a movable part for providing the depth and alignment adjustment. A pin, slidable within the carriage, has a first end engaged with the soft close track and a second end simultaneously engaged with the guide block provides the soft close and push-to-open functionalities.

7 Claims, 17 Drawing Sheets

(56) References Cited

U.S. PATENT DOCUMENTS

| | | | | |
|---|---|---|---|---|
| 8,052,232 | B1 | 11/2011 | Chen | |
| 8,083,304 | B2 | 12/2011 | Hu | |
| 8,091,971 | B2 | 1/2012 | Ward et al. | |
| 8,152,252 | B2 | 4/2012 | Liang et al. | |
| 8,231,189 | B2 | 7/2012 | Liang et al. | |
| 8,256,853 | B2 | 9/2012 | Chen et al. | |
| 8,297,722 | B2 | 10/2012 | Chambers et al. | |
| 8,590,989 | B2 | 11/2013 | Lowe | |
| 8,733,865 | B1 | 5/2014 | Chambers et al. | |
| 8,801,120 | B2 | 8/2014 | Chen et al. | |
| 8,851,586 | B1 | 10/2014 | Huang | |
| 8,939,525 | B1 * | 1/2015 | Chen | A47B 88/047 312/333 |
| 2005/0231083 | A1 | 10/2005 | Garcie, Jr. | |
| 2009/0230830 | A1 | 9/2009 | Ng | |
| 2011/0169389 | A1 | 7/2011 | Jeffries et al. | |
| 2012/0176015 | A1 * | 7/2012 | Liang | A47B 88/427 312/334.4 |
| 2014/0363107 | A1 * | 12/2014 | Egger | F16C 29/02 384/21 |
| 2015/0164223 | A1 | 6/2015 | Lawson | |
| 2015/0374125 | A1 * | 12/2015 | Goetz | A47B 88/0477 312/319.1 |

OTHER PUBLICATIONS

"Concealed Runners—Soft Close and Push-to-Open," Components Direct, comdir.co.uk, http://www.comdir.co.uk/Products.aspx/nttcdfbnuq/ConcealedRunners-SoftCloseAndPush-To-Open/; Accessed: Jun. 2015, 2 pages.

"Temax Shanghai Consealed Automatic Drawer Slide Soft Close and Push Open Drawer Slide," TeMax® Furniture Hardware, Alibaba, temax.en.alibaba.com, http://temax.en.alibaba.com/product/1158089691-800841360/Temax_shanghai_Consealed_Automatic_Drawer_Slide_Soft_Close_and_Push_Open_Drawer_Slide; Accessed: Jun. 2015, 3 pages.

"75-lb. Push-to-Open, Soft-Close Drawer Slides—King Slide® 1A88F," Rockler®, rockler.com, http://www.rockler.com/kingslidereg-1a88f-push-to-open-soft-close-drawer-slides; Accessed: Jun. 2015, 3 pages.

* cited by examiner

PUSH-TO-OPEN, SOFT CLOSE DRAWER SLIDE APPARATUS AND METHOD OF USE

FIELD OF INVENTION

This disclosure relates to the field of drawer slides for mounting drawers in cabinetry. More particularly this disclosure relates to a drawer slide assembly providing a push-to-open functionality and a soft close functionality while also providing a drawer face depth and alignment adjustment.

BACKGROUND

Drawer slide assemblies include slides or rails mounted on both the cabinet carcass and the drawer. The slides attached to the drawer cooperate with the slides mounted to the cabinet carcass to allow telescoping extensions while providing support for the drawer. Drawer slides typically are mounted either underneath the drawer or on the sides of a drawer. Opening devices and closing devices fitted to the rails of drawer slide assemblies help prevent premature damage to the rails as well as the drawer and cabinet by controlling the opening and closing movements of the drawer. A push-to-open device provides a consistent, controlled opening force while also preventing unwanted inadvertent opening of a closed drawer. A soft close device damps inconsistent, user initiated closing forces and provides a controlled closing motion.

Adjustment of the drawer face of a drawer mounted using a drawer slide assembly is important to appearance and is necessary due to manufacturing tolerances. Drawer slide adjustment mechanisms overcome misalignment of an installed drawer relative to the cabinet and any adjacent drawers.

Push-to-open devices, soft close devices, as well as, drawer slide adjustment mechanisms are known in the art. However, the art fails to provide a device attachable to a drawer slide assembly that can accomplish all three functionalities.

U.S. Patent Application Publication No. 2005/0231083 to Garde, Jr. discloses a drawer slide assembly with a self closer apparatus that controls the closing movement of a drawer and further provides a vertical adjustment capability. No push-to-open functionality is disclosed.

U.S. Pat. No. 7,802,856 to Hashemi, et al. discloses a drawer slide assembly with a push-latch device. The push-latch device includes a guide block carried by the outer slide member of the drawer slide assembly. The guide block includes a catch biased to a neutral position by a pair of springs. The catch interacts with a pin mounted on the inner slide to retain the drawer slide in a closed position. As the pin is moved into contact with the catch, the inner slide loads a spring which will force the inner slide towards an open position once the pin is released from the catch. No soft close or adjustment capability is disclosed.

U.S. Pat. No. 8,801,120 to Chen, et al. discloses a self-opening and self-closing slide assembly. An open-close device includes a movable unit and a passive unit fixed to a cabinet rail, a synchronic unit attached to an intermediate rail, and a hooking unit mounted to a cabinet rail. Each "unit" includes many components including frames, push members, protrusions, springs, movable members, and links which are complicatedly assembled and precisely positioned such that the units can engage one another. No drawer face adjustability is disclosed.

A simply assembled, compact, cost effective, and easy to operate solution providing a soft close and push-to-open drawer slide assembly capable of adjusting the position of the drawer face relative to the cabinet and any adjacent drawers is needed.

SUMMARY

The apparatus disclosed mounts to a drawer slide assembly, comprised of a cabinet rail mounted to the cabinet carcass, an intermediate rail slidingly engaged with the cabinet rail, and a drawer rail mounted to a drawer and slidingly engaged with the intermediate rail. The apparatus is capable of providing push-to-open, soft close, and drawer depth and alignment adjustment functionalities.

Accordingly, the apparatus comprises a housing mounted to either the drawer rail or the cabinet rail slidingly engaged with a guide block mounted to the other of either the drawer rail or the cabinet rail. The housing comprises a base mounted to either rail which includes a damper, an ejector and ejector spring, and a set of soft close springs attached to a carriage slidingly engaged with a soft close track attached to the base. The carriage includes a dog slidable in a direction generally perpendicular to the direction of travel of the drawer. The dog carries a pin having a first end slidingly engaged with the soft close track and simultaneously engaged with a guide block mounted to another rail. The guide block comprises a stationary part adjustably connected to a movable part via a threaded shaft and a thumbwheel. Rotation of the thumbwheel adjusts the position of the movable part relative to the stationary part and thus provides a depth adjustment of the drawer relative to the cabinet carcass. In one embodiment, the apparatus is installed on a single drawer slide assembly. In an alternate embodiment, the apparatus is installed on two separate slide assemblies for the same drawer. Rotation of the thumbwheels allows synchronization of the left and right hand drawer slide assemblies for drawer alignment within the cabinet carcass.

The pin engaged with a set of channels, catches, and redirecting surfaces in the guide block provides the push-to-open functionality while the same pin engaged with another set of redirecting surfaces and catches provides the soft close functionality.

BRIEF DESCRIPTION OF DRAWINGS

In the descriptions that follow, like parts are marked throughout the specification and drawings with the same numerals, respectively. The drawing figures are not necessarily drawn to scale and certain figures may be shown in exaggerated or generalized form in the interest of clarity and conciseness.

DETAILED DESCRIPTION OF PREFERRED EMBODIMENTS

Figure 1:
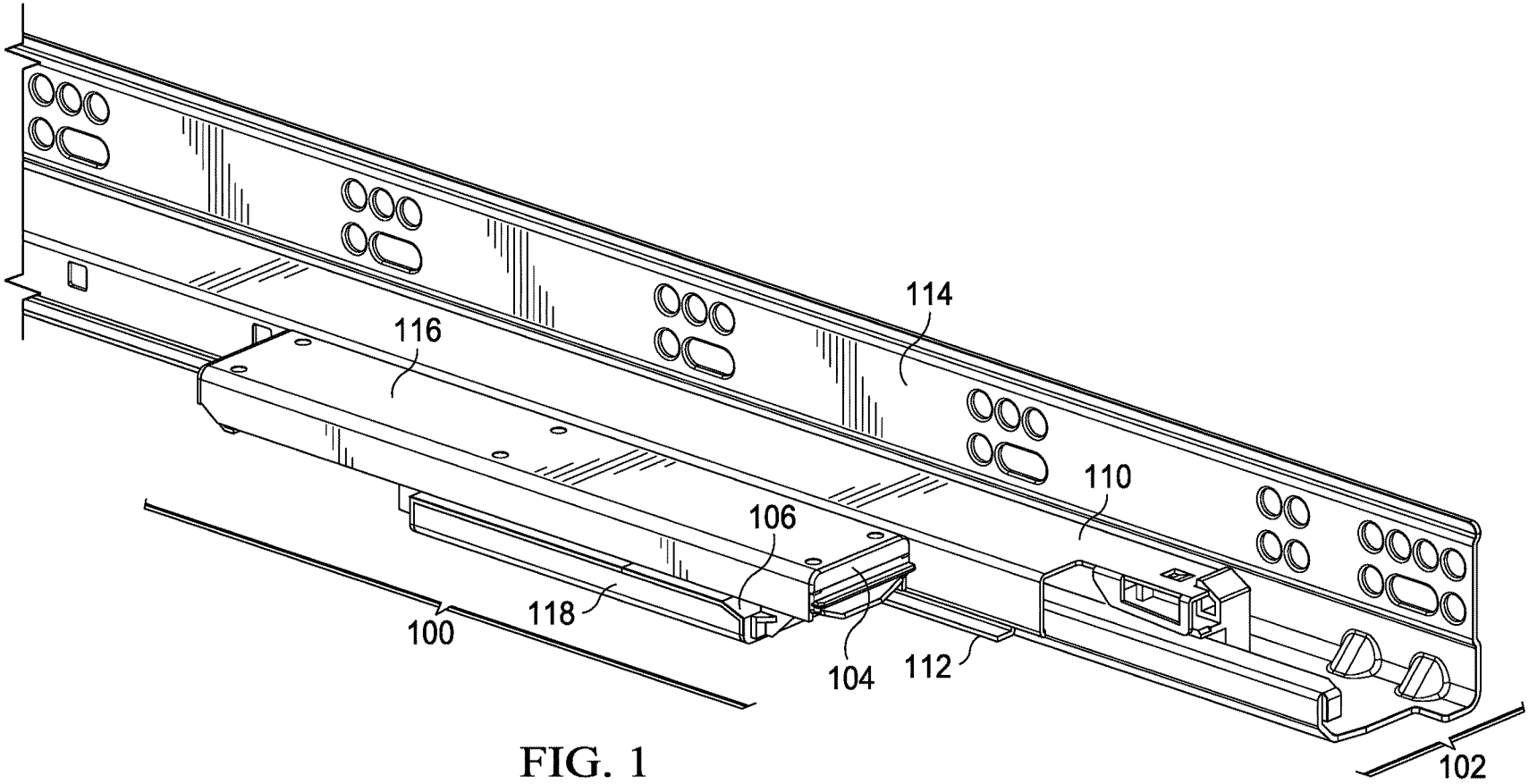
FIG. 1 is an isometric view of a preferred embodiment.
Figure 2:
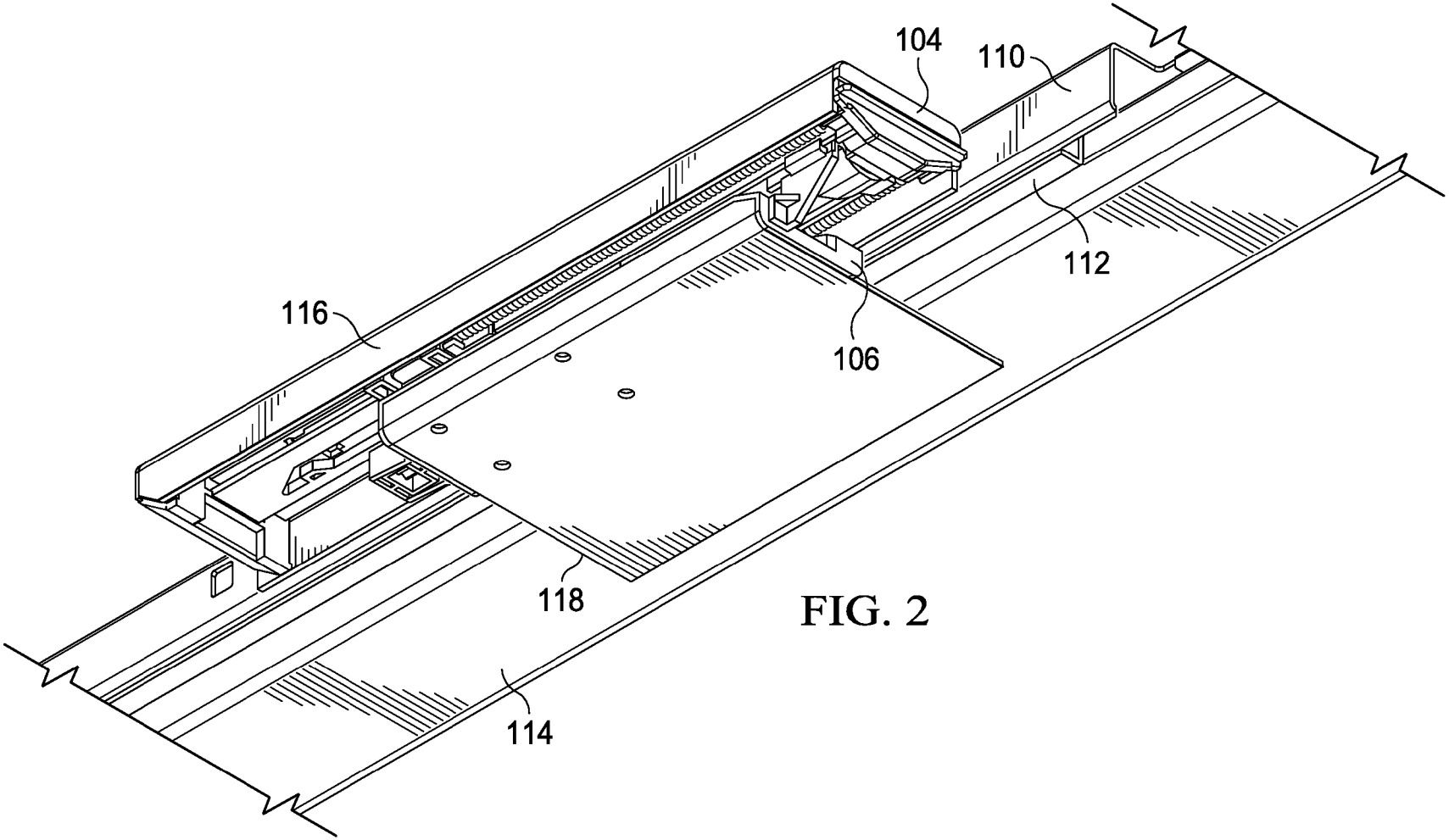
FIG. 2 is an isometric view of a preferred embodiment.

Referring to FIGS. 1 and 2, push-to-open, soft close drawer slide apparatus 100 is mounted to drawer slide assembly 102. Push-to-open, soft close drawer slide apparatus 100 is comprised of housing 104 slidingly engaged with guide block 106. Drawer slide assembly 102 is comprised of three slidingly engaged, telescoping rails. However, the number of rails in the drawer slide assembly does not matter to the functionality of the apparatus. Drawer rail 110 is slidingly engaged with intermediate rail 112 and generally affixed to a drawer (not shown) with conventional mounting hardware such as wood screws. Intermediate rail 112 is slidingly engaged with cabinet rail 114 where cabinet rail 114 is generally fixed to a cabinet carcass (not shown). Housing 104 is fixed to drawer rail 110 via mounting plate 116. Guide block 106 is fixed to cabinet rail 114 via mounting plate 118.

Figure 3A:
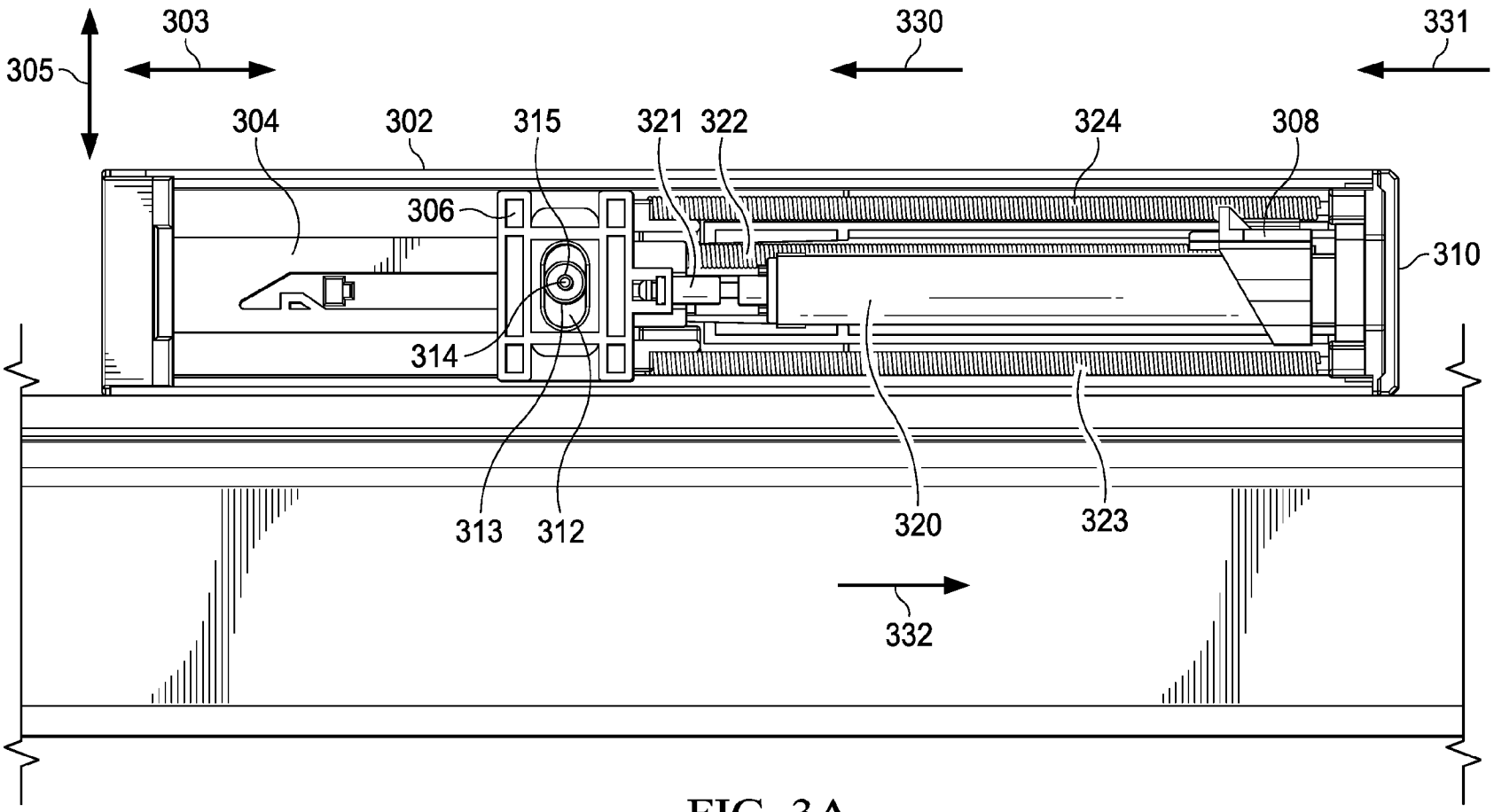
FIG. 3A is a plan view of the underside of a drawer rail housing of a preferred embodiment.
Figure 3B:
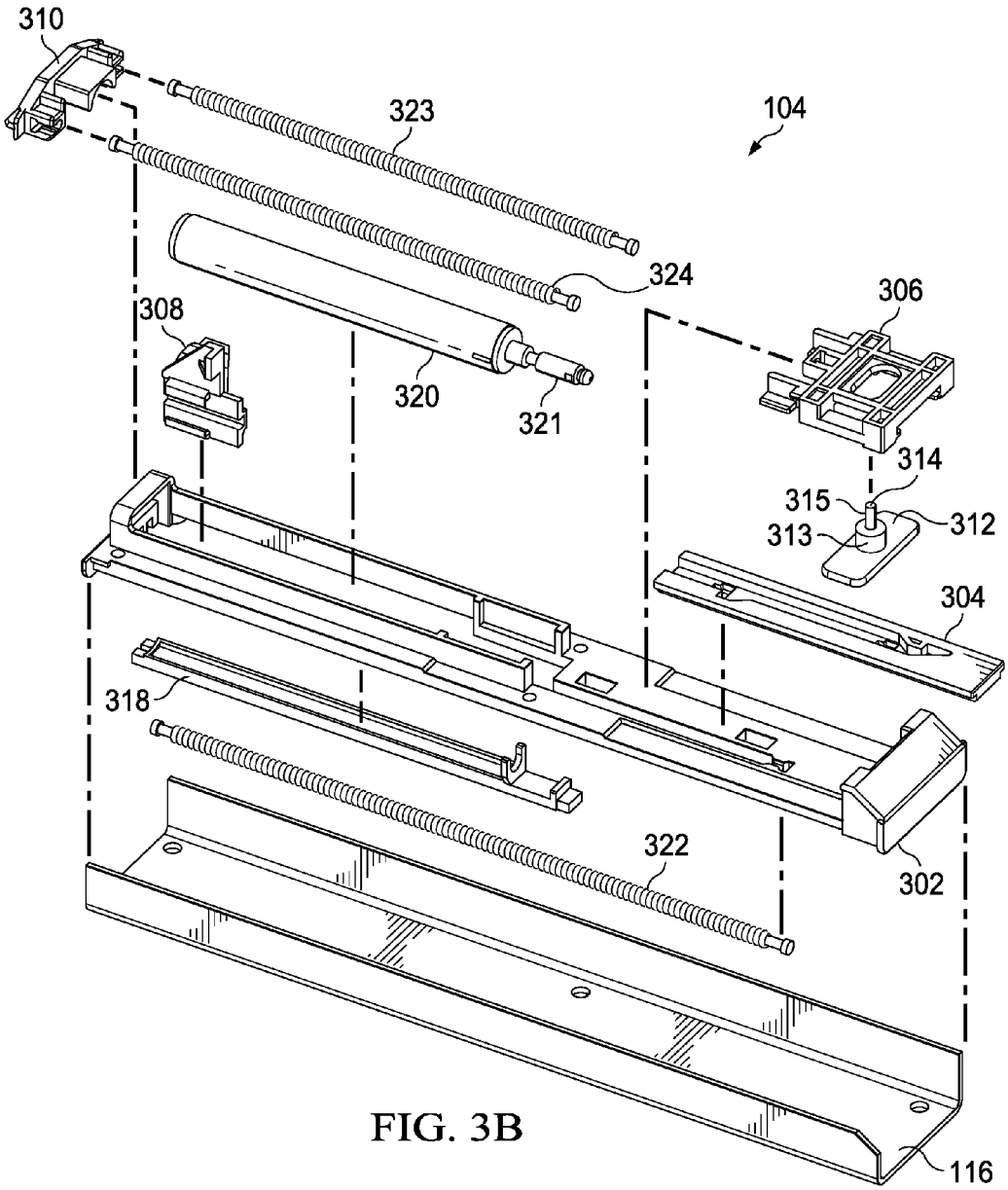
FIG. 3B is an exploded isometric view of the topside of a drawer rail housing of a preferred embodiment.
Figure 3C:
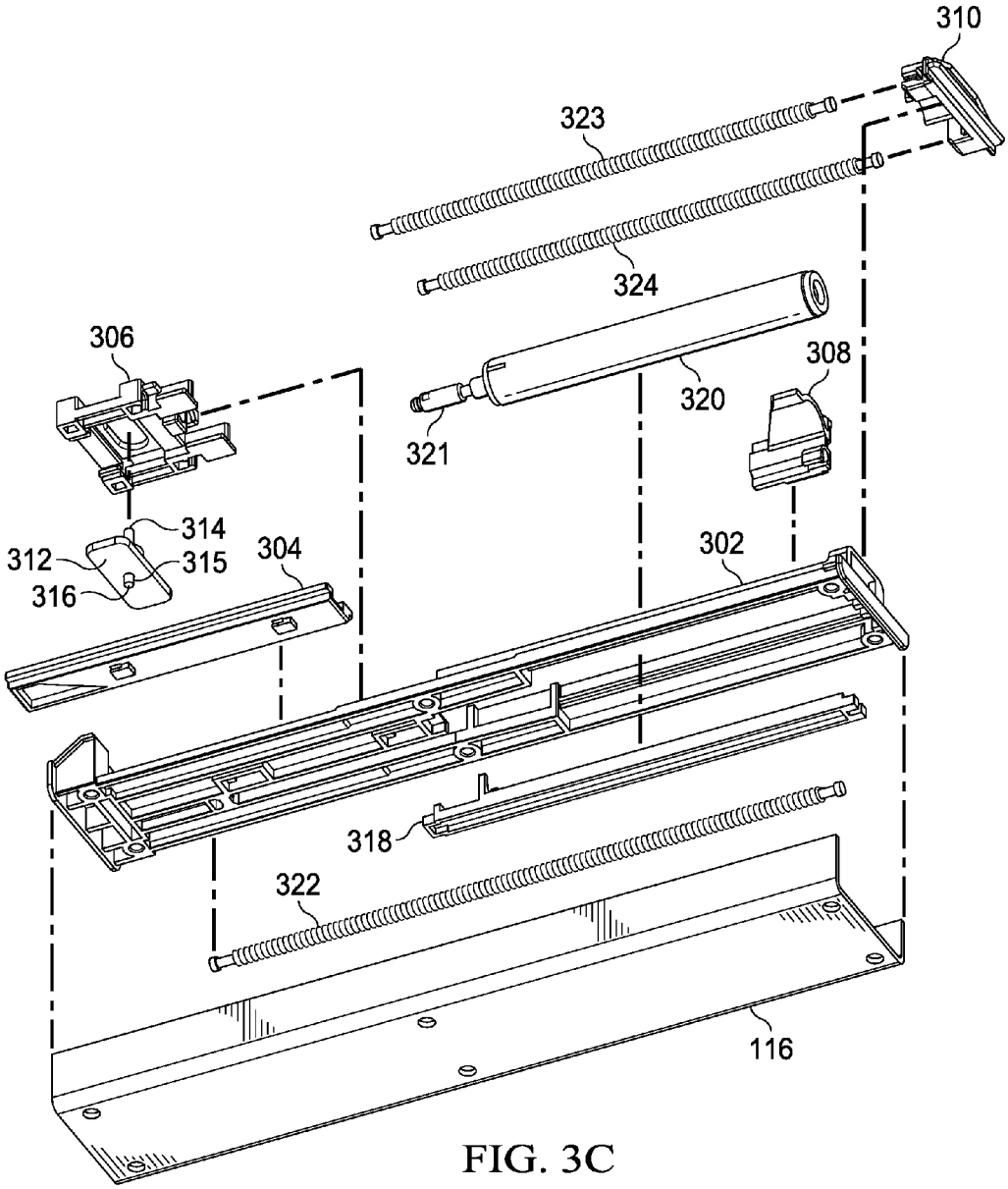
FIG. 3C is an exploded isometric view from the underside of a drawer rail housing of a preferred embodiment.

Referring to FIGS. 3A-3C, housing 104 comprises base 302 mounted to mounting plate 116. Soft close track 304 fits into base 302. Carriage 306 is slidingly engaged with soft close track 304 and moves with respect to base 302 in direction 303. Ejector 308 is slidingly engaged with base 302 and moves with respect to base 302 in direction 303. Cap 310 is slidingly engaged with an end of base 302. Dog 312 is slidingly engaged with carriage 306 and moves with respect to carriage 306 in direction 305. Dog 312 is generally planar and includes cylindrical step 313 extending from one side. Pin 315 extends from opposing sides of dog 312. In one embodiment, ends 314 and 316 of pin 315 are axially aligned. In an alternate embodiment, dog 312 includes two separate pins extending from opposite sides of dog 312. In this embodiment, the pins may or not be axially aligned. Brace 318 is press fit onto base 302. Damper 320 is supported by brace 318. Piston rod 321 extends from damper 320 and engages carriage 306. Ejector spring 322 is connected to ejector 308 and base 302 and creates ejector force 330 such that ejector 308 tends to move towards carriage 306 and away from cap 310. Soft close springs 323 and 324 are connected to cap 310 and carriage 306 and create soft close force 332 such that carriage 306 is biased toward cap 310 and supplemental ejector force 331 such that cap 310 is biased towards carriage 306. Soft close force 332 created by the soft close springs is greater than ejector force 330 created by the ejector spring.

Figure 4A:
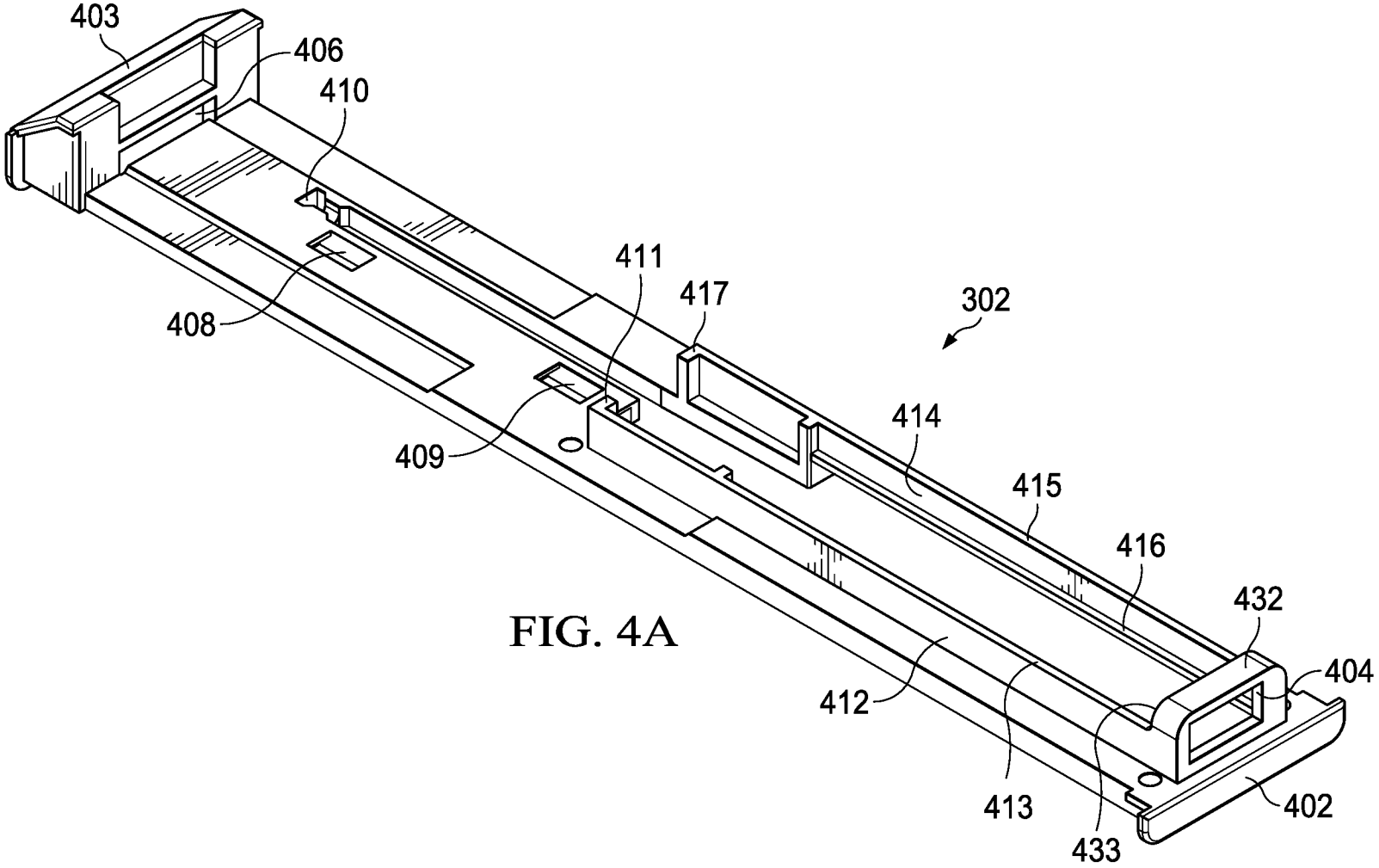
FIG. 4A is an isometric view of a base of a preferred embodiment.

Referring to FIG. 4A, base 302 is shown. Base 302 is attached to mounting plate 116 with screws, rivets, or a suitable adhesive. Base 302 has ends 402 and 403. Footing 432 extends from base 302 at end 402. Footing 432 includes a rectangular shaped aperture 404 sized to receive cap 310. Footing 432 further includes surface 433 facing end 403. End 403 includes slot 406. Slots 406, 408, and 409 receive tabs from soft close track 304 to secure soft close track 304 to base 302. Slot 410 secures an end of ejector spring 322. Ridges 412 and 414 extend from footing 432 lengthwise along base 302 and include flat surfaces 413 and 415 respectively. Ridges 412 and 414 terminate at ends 411 and 417, respectively. Ridge 414 includes ledge 416.

Figure 4B:
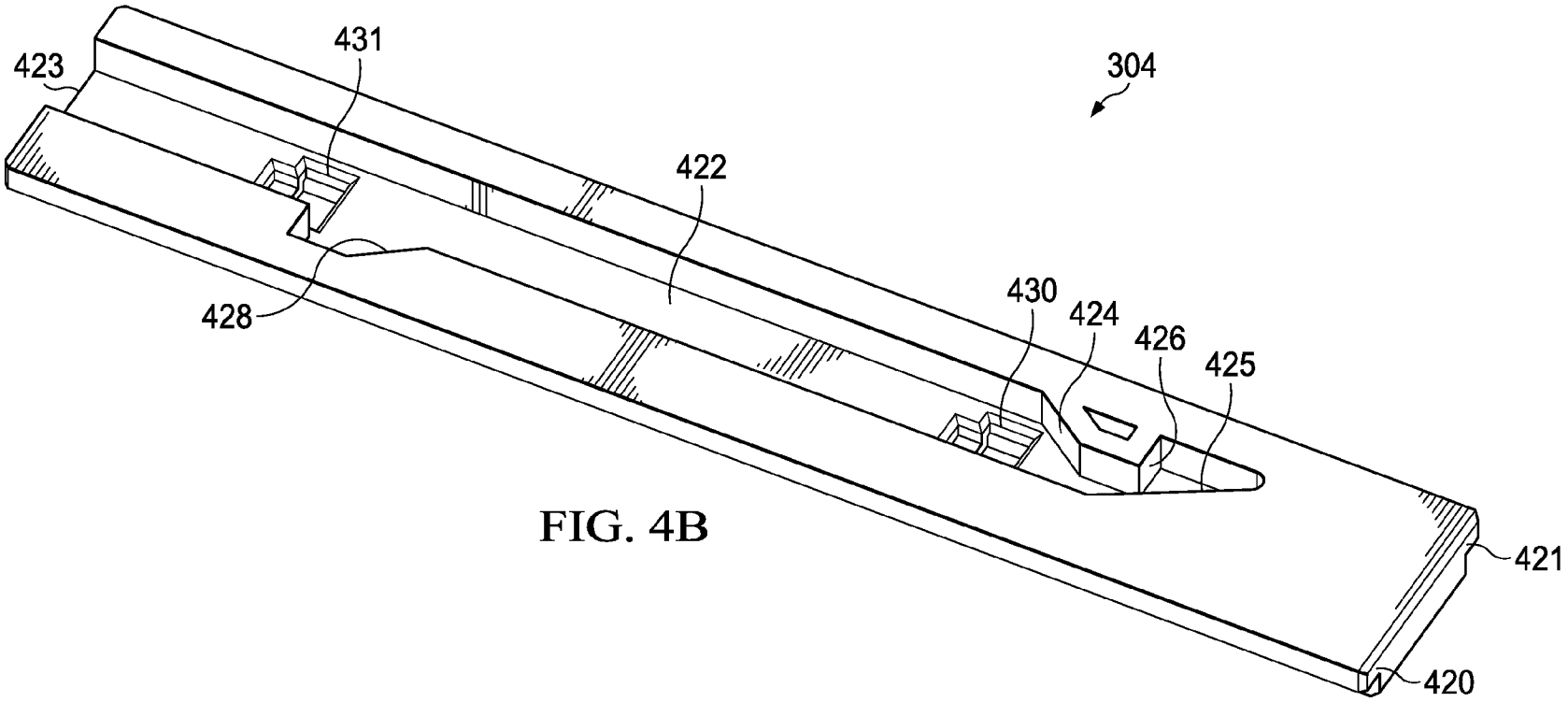
FIG. 4B is an isometric view of a soft close track of a preferred embodiment.

Referring to FIG. 4B, soft close track 304 is shown. Soft close track 304 includes flanges 420 and 421 which run through the length of soft close track 304. Groove 422 extends from end 423 lengthwise along soft close track 304. Groove 422 defines redirecting surfaces 424, 425, and catch 426. Groove 422 further includes recess 428. Tabs 430 and 431 extend from soft close track 304 and serve to frictionally secure soft close track 304 to base 302 via slots 408 and 409, respectively.

Figure 4C:
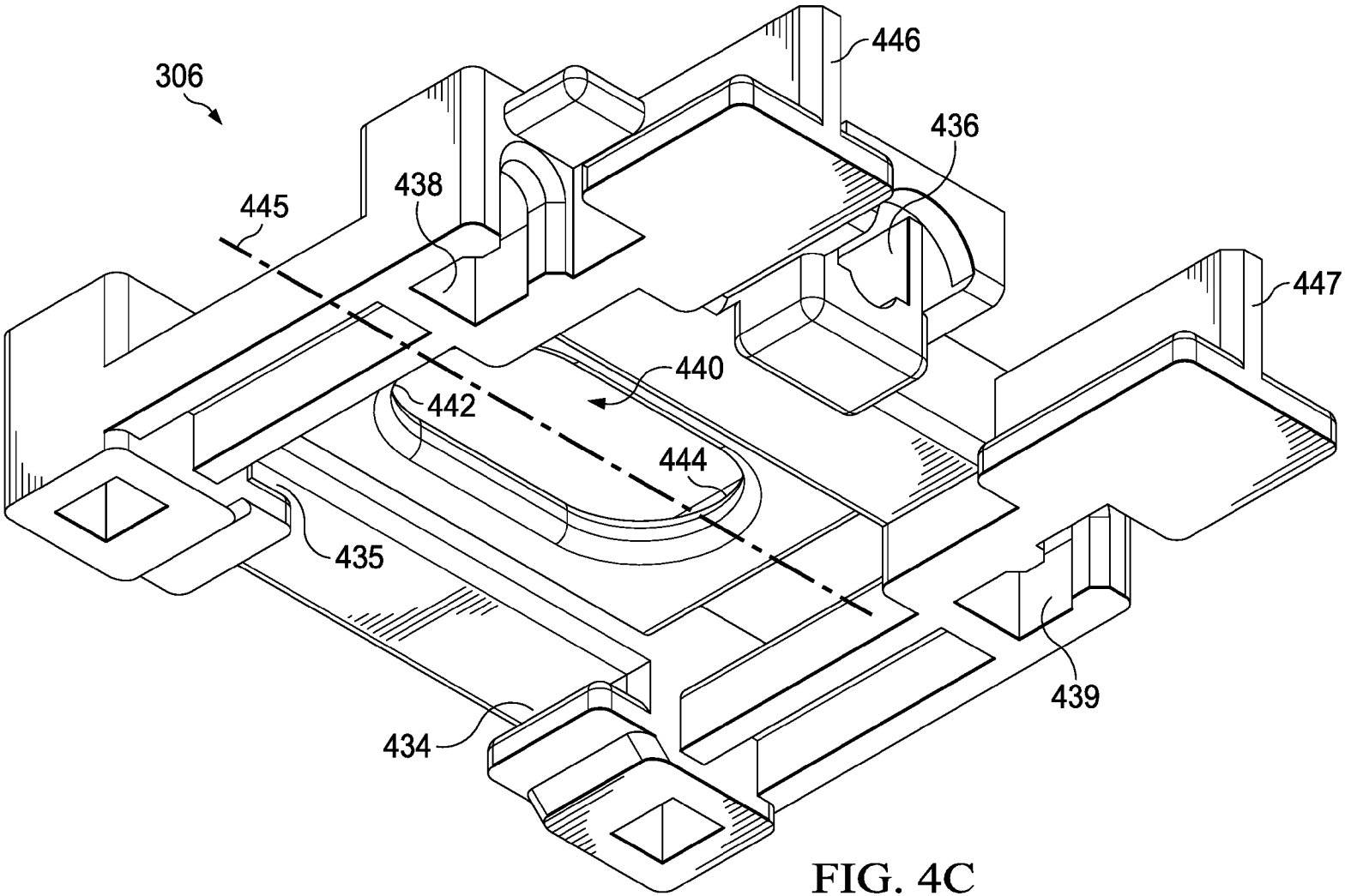
FIG. 4C is an isometric view of a carriage of a preferred embodiment.

Referring to FIG. 4C, carriage 306 is shown. Carriage 306 is generally rectangular. Carriage 306 defines opposing slots 434 and 435 sized to slidingly engage flanges 420 and 421 of soft close track 304. Slot 436 secures piston rod 321 to carriage 306. Slots 438 and 439 secure one end each of soft close springs 323 and 324 to carriage 306. Soft close springs 323 and 324 extend the length of base 302 along ridges 412 and 414 and connect to cap 310. Oblong hole 440 is generally centrally positioned in carriage 306 and is sized to receive cylindrical step 313. Oblong hole 440 has ends 442 and 444. Oblong hole 440 has a latitudinal axis 445 that is generally perpendicular to the direction of travel of the drawer. Abutments 446 and 447 extend from carriage 306 for contact with ends 411 and 417, respectively.

Figure 4D:
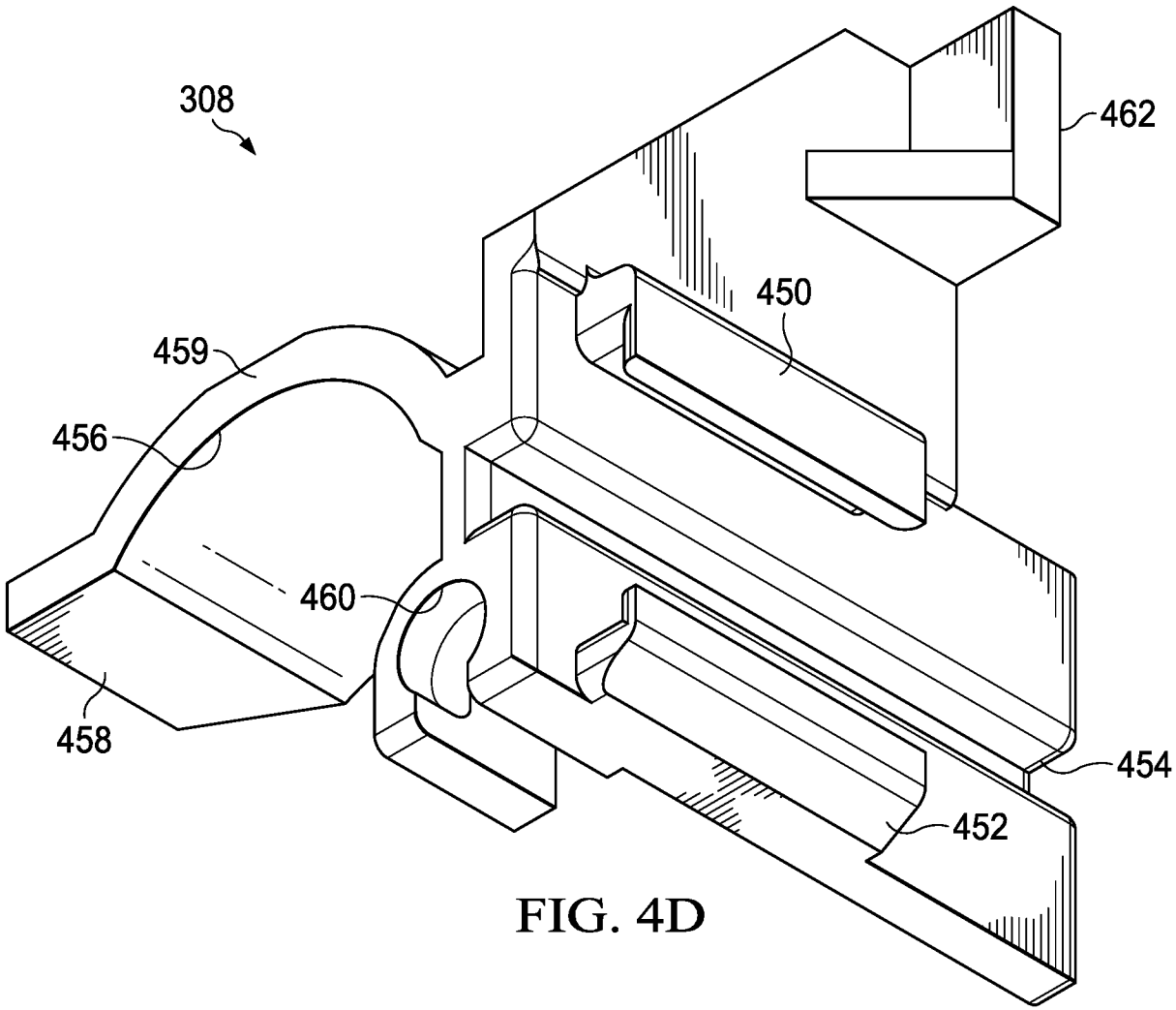
FIG. 4D is an isometric view of an ejector of a preferred embodiment.

Referring to FIG. 4D, ejector 308 is shown. Flanges 450 and 452 are spaced apart and sized to slidingly engage ridge 414. Flange 450 contacts flat surface 415. Groove 454 is positioned between flanges 450 and 452 and is sized to slidingly engage ledge 416. Ejector 308 defines arch 456. Arch 456 spans damper 320 and forms a bridge to support 458. Arch 456 and support 458 include surface 459 for contact with base 302 and cap 310. Support 458 slidingly engages flat surface 413 of ridge 412. Slot 460 secures one end of ejector spring 322 to ejector 308. Protrusion 462 provides a flat surface for contact with guide block 106.

Figure 4E:
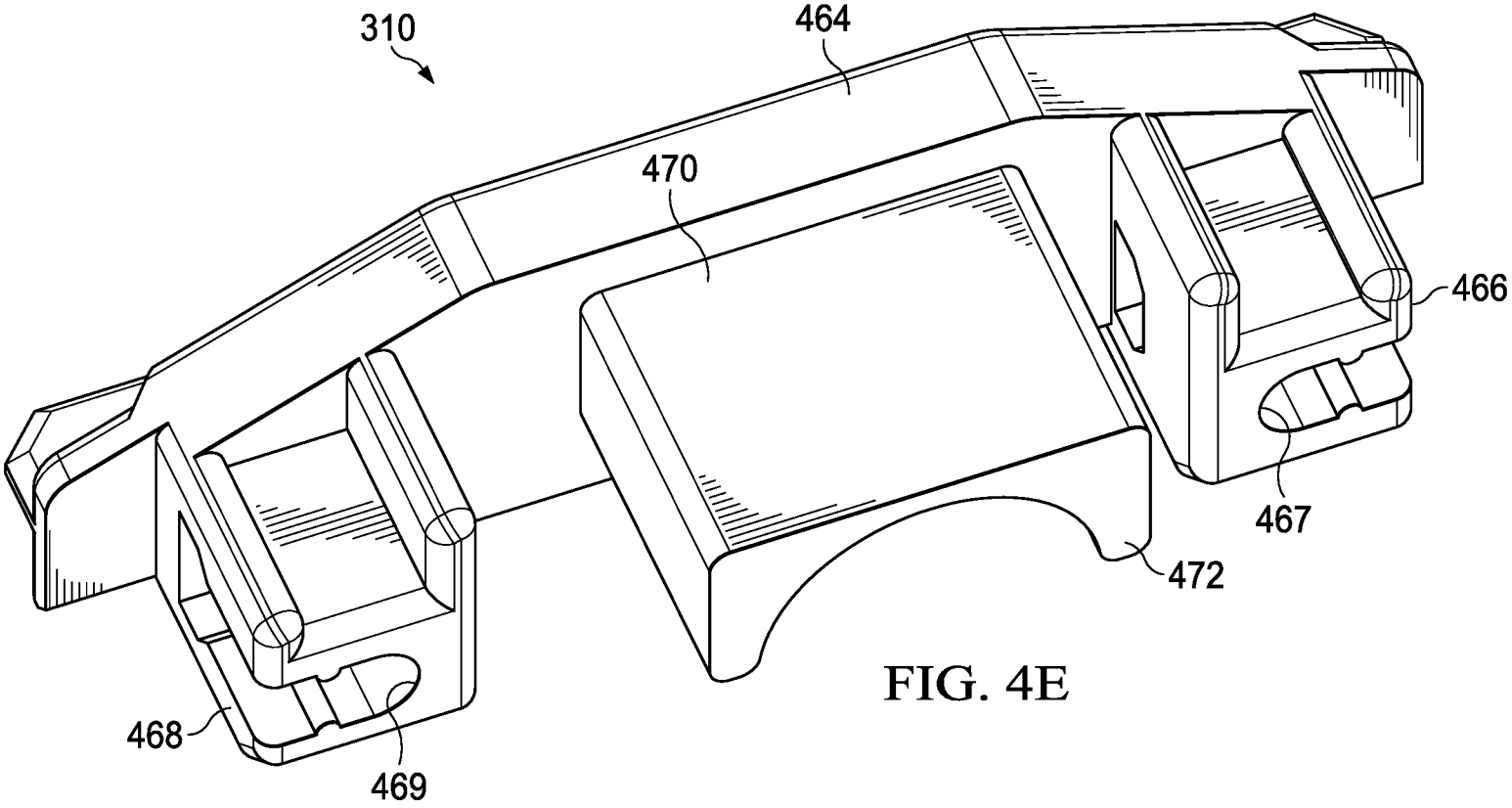
FIG. 4E is an isometric view of a cap of a preferred embodiment.

Referring to FIG. 4E, cap 310 is shown. Posts 466 and 468 extend from bridge 464. Posts 466 and 468 are spaced apart such that post 466 is adjacent ridge 412 and post 468 is adjacent ridge 414. Posts 466 and 468 includes slots 467 and 469, respectively. Slots 467 and 469 engage springs 323 and 324, respectively. Segment 470 extends from bridge 464 and is sized to slidingly engage aperture 404. Segment 470 includes surface 472 for contact with surface 459.

Figure 5A:
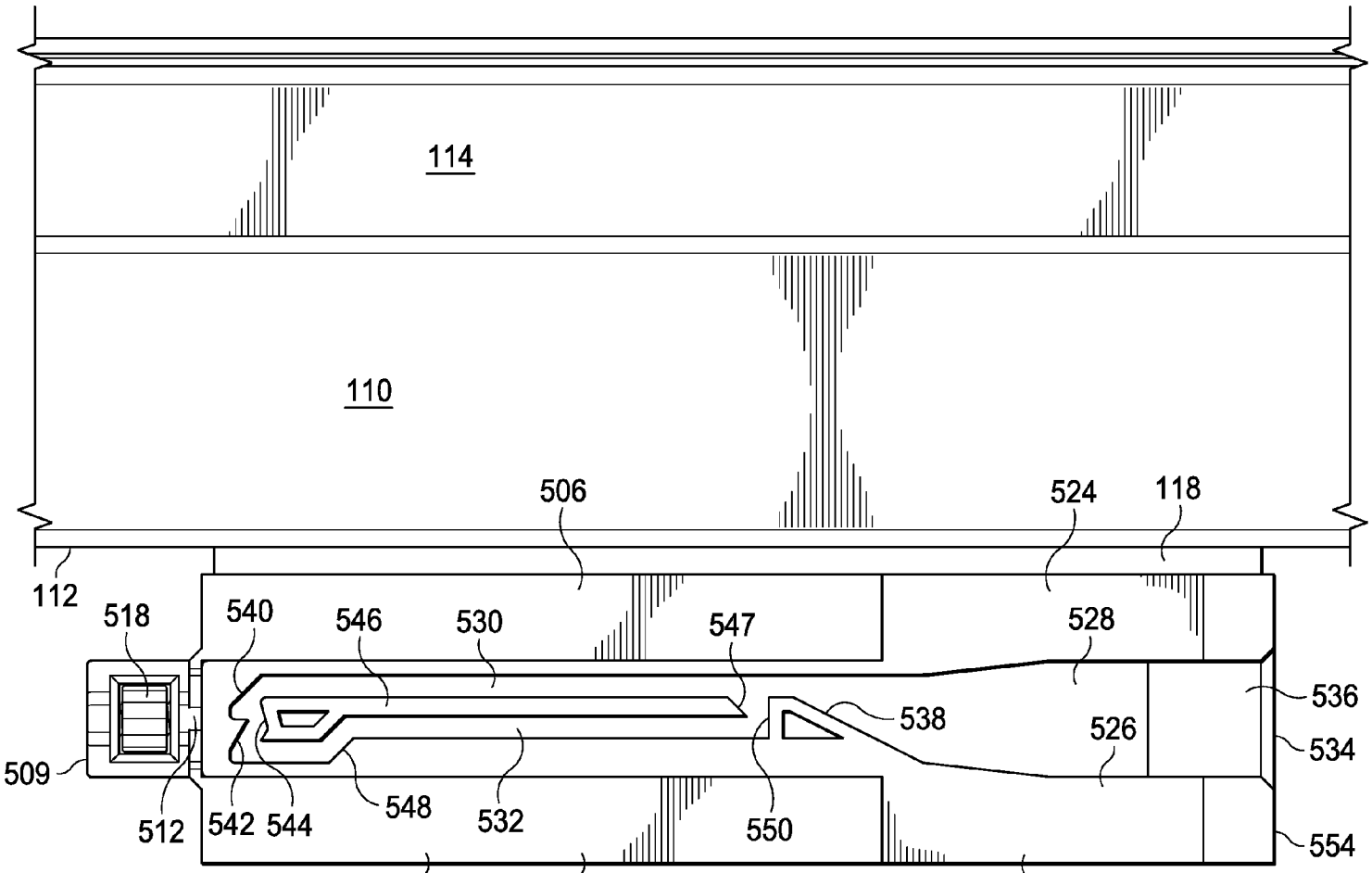
FIG. 5A is a plan view of a guide block of a preferred embodiment.
Figure 5B:
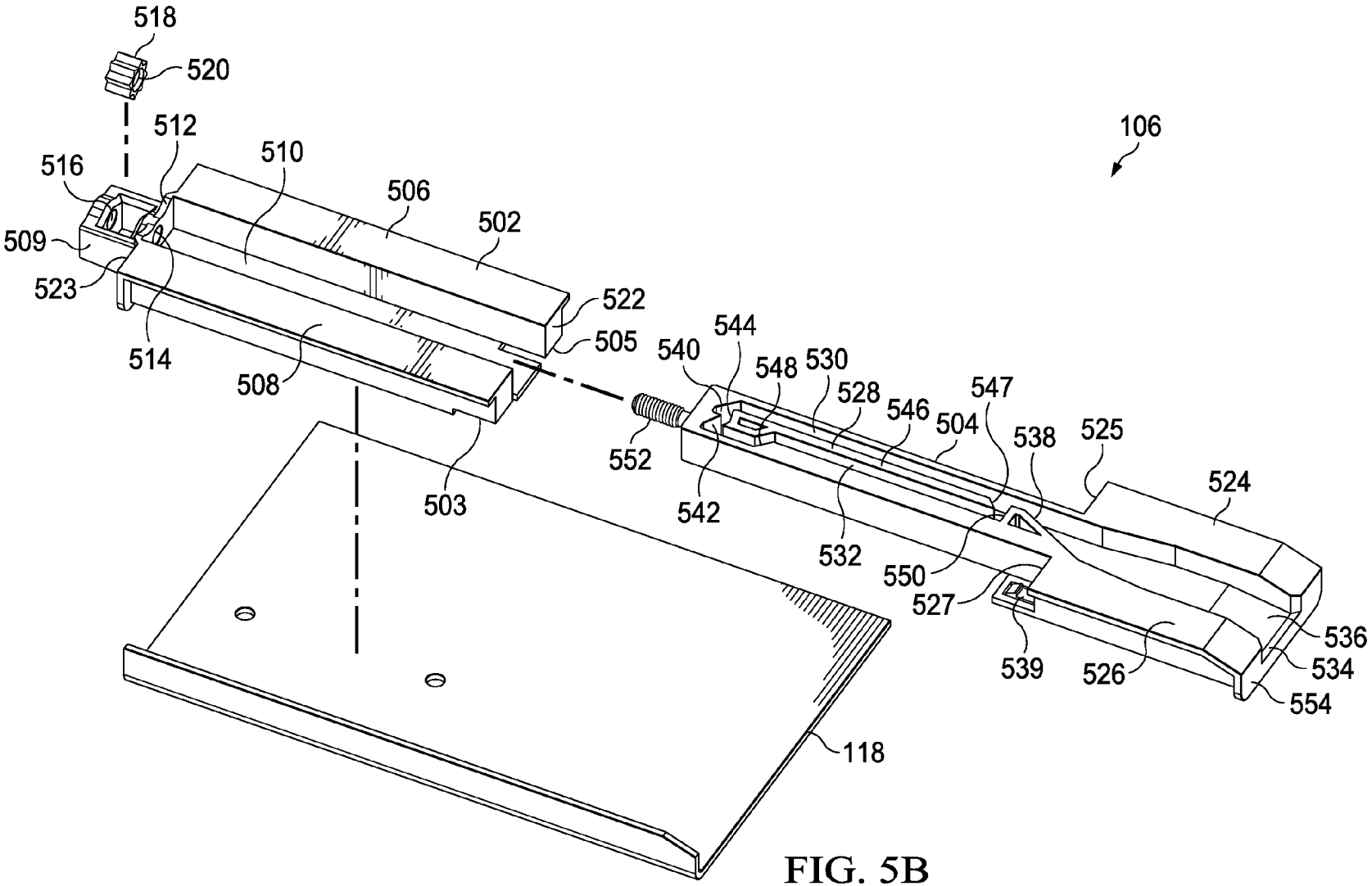
FIG. 5B is an exploded isometric view of a guide block of a preferred embodiment.

Referring to FIGS. 5A-5B, guide block 106 comprises stationary part 502 slidingly engaged with movable portion 504. Stationary part 502 is attached to mounting plate 118 with screws, rivets, or a suitable adhesive. Stationary part 502 includes segments 506 and 508 separated by gutter 510 which is open at end 522 and connected by bridge 512 at end 523. Bridge 512 includes hole 514. Segments 506 and 508 support carriage 509. Carriage 509 includes hole 516. Carriage 509 is sized to receive thumbwheel 518. Hole 516 is axially aligned with hole 514. Thumbwheel 518 includes threaded hole 520. Threaded hole 520 is axially aligned with holes 514 and 516.

Movable portion 504 is slidingly engaged with gutter 510. The position of movable portion 504 is adjustable with respect to stationary part 502. Movable portion 504 includes segments 524 and 526 separated by push-to-open track 528. Segments 524 and 526 define shoulders 525 and 527, respectively. Segment 526 further includes abutment 554. A pair of spring tabs 539 extend from segments 524 and 526 proximate shoulders 525 and 527. Spring tabs 539 releasably engage slots 503 and 505 on segments 506 and 508 at end 522 of stationary part 502. Push-to-open track 528 generally extends the entire length of movable portion 504. Push-to-open track 528 defines inlet channel 530 and outlet channel 532. Push-to-open track 528 further includes opening 534 which leads to ramp 536. Ramp 536 and redirecting surface 538 create a funnel which connects to inlet channel 530 and outlet channel 532. At the end of inlet channel 530 is redirecting surface 540. At the beginning of outlet channel 532 is redirecting surface 542. Positioned between redirecting surfaces 540 and 542 is catch 544 defined by island 546. Island 546 includes angled surface 547. Angled surface 547 is included as a safety measure to ensure that end 314 of pin 315 does not accidently enter outlet channel 532. Island 546 separates inlet channel 530 from outlet channel 532. Outlet channel 532 defines redirecting surface 548. At the end of outlet channel 532 is catch 550. Catch 550 redirects outlet channel 532 at an approximate right angle back to inlet channel 530. Threaded shaft 552 extends from movable portion 504 opposite opening 534. Threaded shaft 552 is sized to pass through holes 514 and 516 and includes a set of threads sized to engage threaded hole 520 of thumbwheel 518.

In a preferred embodiment, components of push-to-open, soft close drawer slide apparatus 100 are manufactured of steel or molded plastic such as polystyrene, PVC (polyvinyl chloride), or nylon.

Although it is disclosed that housing 104 is mounted to a movable drawer rail and that guide block 106 is mounted to a stationary cabinet rail, it will be appreciated that it is also possible, with equal success, that housing 104 is mounted to the stationary cabinet rail and that guide block 106 is mounted to the movable drawer rail.

In use, housing 104 slidingly engages guide block 106 to provide a push-to-open functionality, a soft close functionality, and a drawer face depth and alignment adjustment functionality. The push-to-open and soft close functionalities are accomplished with pin 315 simultaneously interacting with soft close track 304 and push-to-open track 528. Redirecting surfaces along soft close track 304 and push-to-open track 528 contact pin 315 forcing dog 312 to slide linearly along axis 445 of oblong hole 440 within carriage 306.

In an "open position" where the drawer is fully retracted from the cabinet carcass via the drawer slide assembly, the state of the components of push-to-open, soft close drawer slide apparatus 100 are such that carriage 306 is positioned proximate end 403 of base 302 and cylindrical step 313 is positioned at end 442 of oblong hole 440. End 316 of pin 315 is engaged with catch 426. Piston rod 321 is fully extended from the cylinder of damper 320. End 314 of pin 315 is completely disengaged from push-to-open track 528. In the "open position," soft close springs 323 and 324 are held in a tensioned state via the engagement of end 316 of pin 315 with catch 426, thus creating potential energy in soft close springs 323 and 324 equal to soft close force 332. Ejector 308 is adjacent end 411 along ridge 412 and ejector spring 322 is in an un-tensioned state.

Referring to FIGS. 6A-6D the position of pin 315 relative to push-to-open track 528 and soft close track 304 during a closing movement and an opening movement are shown.

Figure 6A:
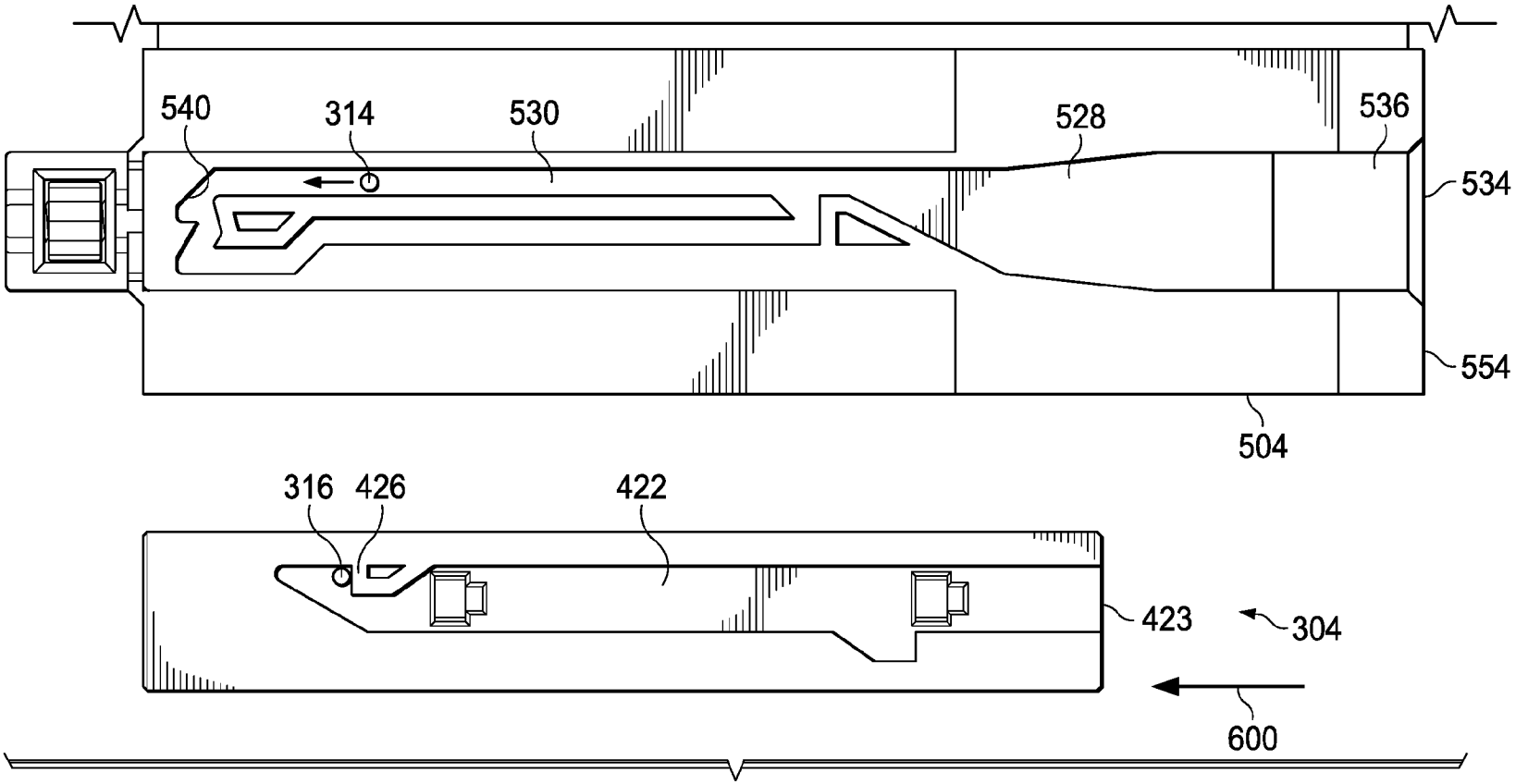
FIG. 6A is a plan view of pin movement through a set of push-to-open channels and a guide block of a preferred embodiment during a closing movement.

As shown in FIG. 6A, a user supplied force on the drawer in closing direction 600 begins a closing movement from the "open position" to a "closed position." As the drawer moves to the "closed position," end 314 of pin 315 first passes through opening 534 and contacts ramp 536. The user supplied force continues to move end 314 of pin 315 through inlet channel 530 towards redirecting surface 540. Protrusion 462 of ejector 308 contacts abutment 554 of movable portion 504. Ejector force 330 begins to build in ejector spring 322 as soft close track 304 continues to move with the drawer slide while ejector 308, prohibited from moving with the drawer slide via its contact with abutment 554, begins to slide along ridges 412 and 414 towards cap 310 against the bias of ejector spring 322.

Figure 6B:
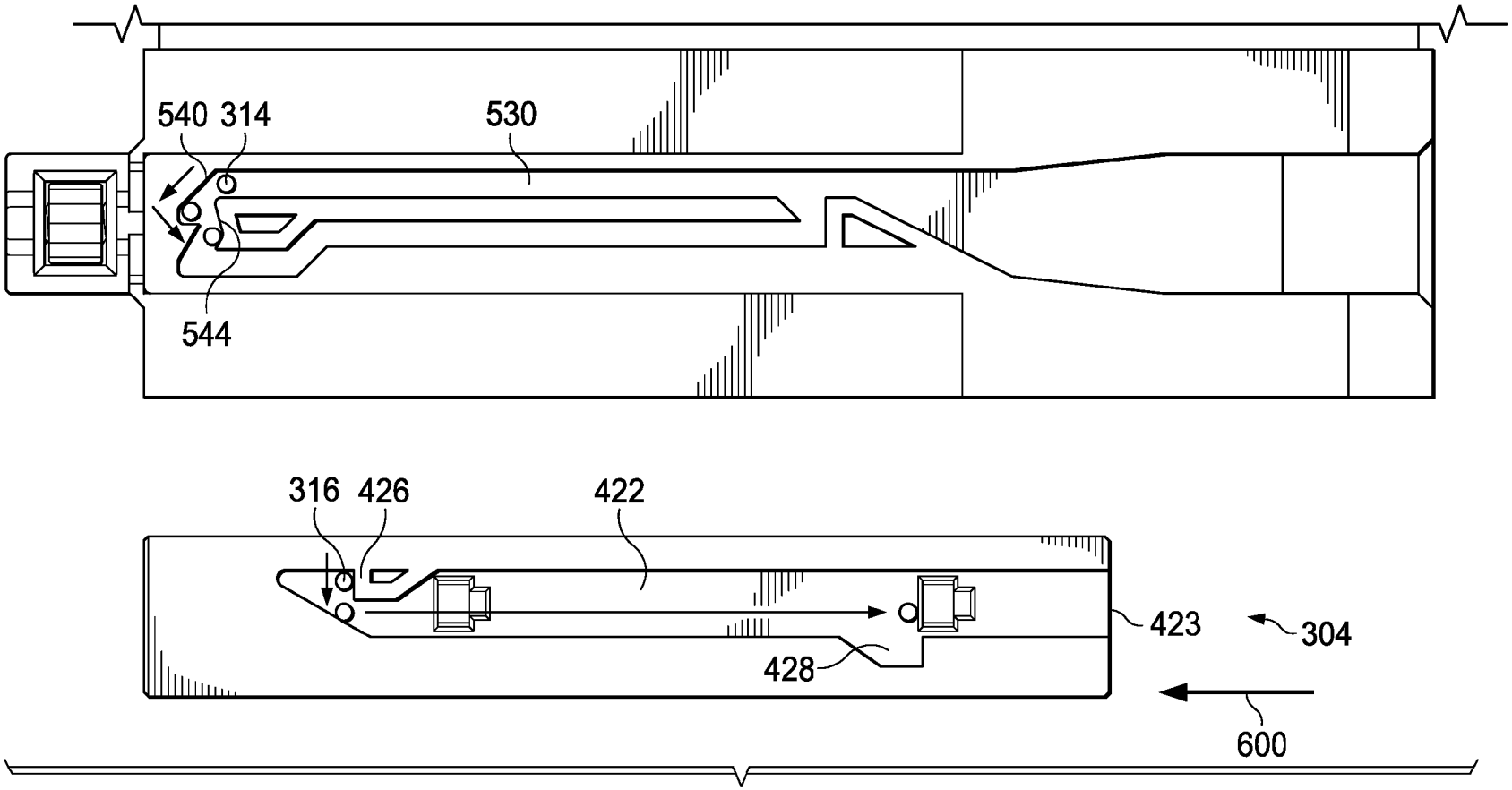
FIG. 6B is a plan view of pin movement through a set of push-to-open channels and a guide block of a preferred embodiment during a closing movement.

As shown in FIG. 6B, end 314 contacts redirecting surface 540 which causes cylindrical step 313 and pin 315 to move to an approximate midpoint between ends 442 and 444 of oblong hole 440. The movement of pin 315 disengages end 316 from catch 426. With pin 315 free from engagement with catch 426, soft close force 332 pulls soft close track 304 and the drawer in closing direction 600 to the "closed position." Carriage 306 slides along soft close track 304 towards cap 310 until abutments 446 and 447 contact ends 411 and 417. End 316 of pin 315 moves through the length of groove 422 to adjacent recess 428. Soft close force 332 also biases end 314 into catch 544. The movement of carriage 306 relative to soft close track 304 urges piston rod 321 into the cylinder of damper 320 which controls the rate of the closing providing the soft close functionality. While soft close track 304 moves, the contact of protrusion 462 with abutment 554 causes ejector 308 to slide along ridges 412 and 414 away from carriage 306 and towards cap 310 thus loading ejector spring 322 with ejector force 330. The drawer is now in the closed position.

In the "closed position" where the drawer is fully retracted into the cabinet carcass via the drawer slide assembly, the state of the components of push-to-open, soft close drawer slide apparatus 100 are such that carriage 306 is positioned proximate end 423 of soft close track 304 and cylindrical step 313 is positioned at an approximate midpoint between ends 442 and 444 of oblong hole 440. End 316 of pin 315 is disengaged from recess 428. Piston rod 321 is fully contained within the cylinder of damper 320. End 314 of pin 315 is engaged with catch 544. In the "closed position," ejector spring 322 is in a tensioned state via the contact of ejector 308 with abutment 554, thus creating potential energy in ejector spring 322 equal to ejector force 330. Soft close springs 323 and 324 are in an un-tensioned state.

Figure 6C:
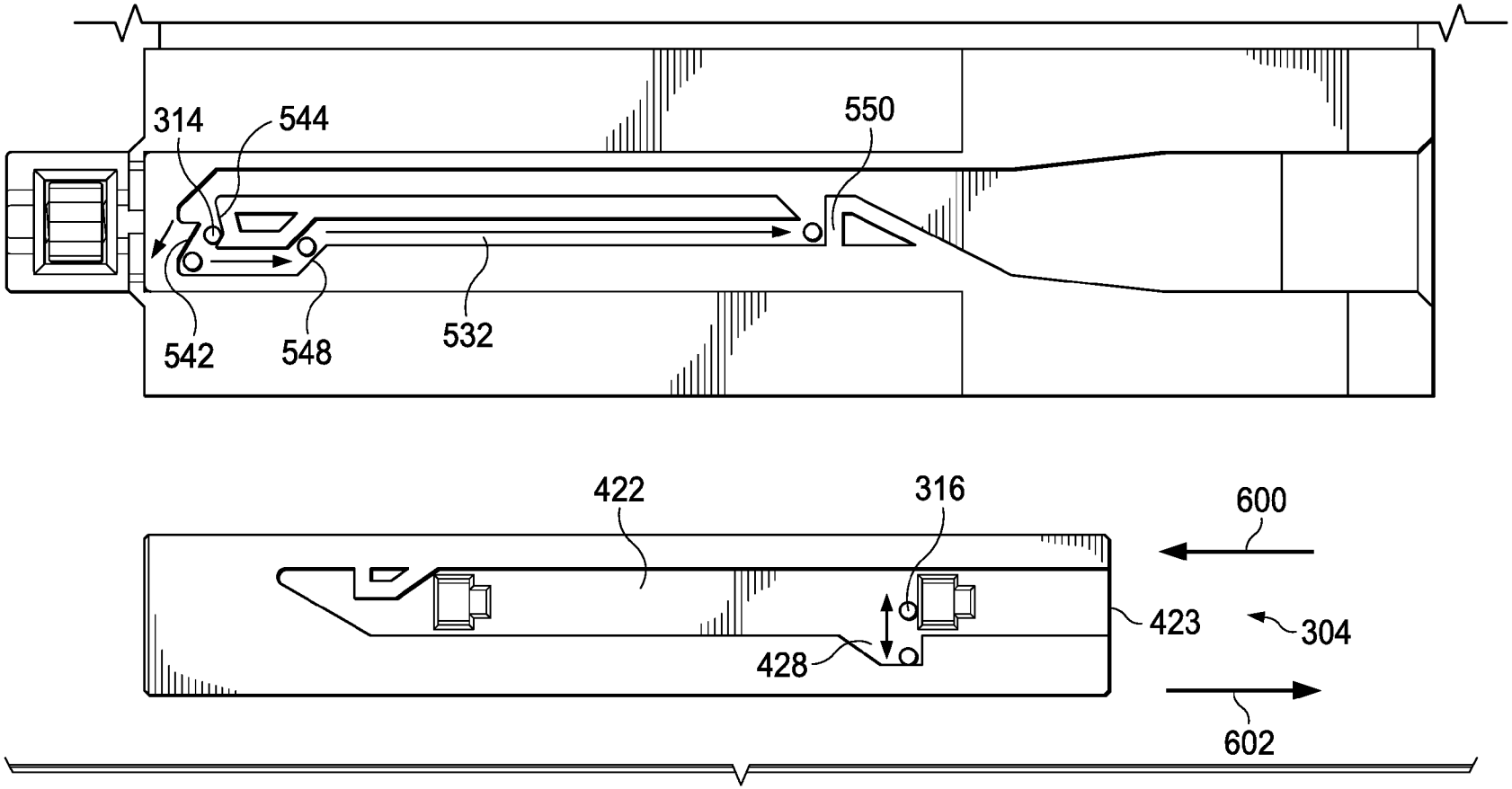
FIG. 6C is a plan view of pin movement through a set of push-to-open channels and a guide block of a preferred embodiment during an opening movement.

As shown in FIG. 6C, in order to move the drawer from the "closed position" to the "open position" an initial user supplied force in closing direction 600 disengages end 314 from catch 544 and towards redirecting surface 542. End 314 contacts redirecting surface 542 which causes cylindrical step 313 and pin 315 to move to end 444 of oblong hole 440 while simultaneously positioning end 316 in recess 428. The initial user supplied force in closing direction 600 also causes surface 459 of ejector 308 to contact surface 472 of cap 310. Segment 470 slides within aperture 404 against the bias of soft close springs 323 and 324 until surface 459 abuts surface 433 creating supplemental ejector force 331. With end 314 released from engagement with catch 544 and the initial user supplied force in the closing direction removed, ejector force 330 and supplement ejector force 331 are released which urges ejector 308 towards carriage 306 effectively forcing the drawer in opening direction 602 and providing the push-to-open functionality. As carriage 306 is forced towards ejector 308 by ejector force 330, end 314 of pin 315 moves through outlet channel 532 towards redirecting surface 548. End 314 contacts redirecting surface 548 which causes cylindrical step 313 and pin 315 to move to an approximate midpoint between ends 442 and 444 of oblong hole 440 while simultaneously moving end 316 out of recess 428. End 314 continues movement through outlet channel 532 towards engagement with catch 550 while end 316 remains adjacent recess 428.

Figure 6D:
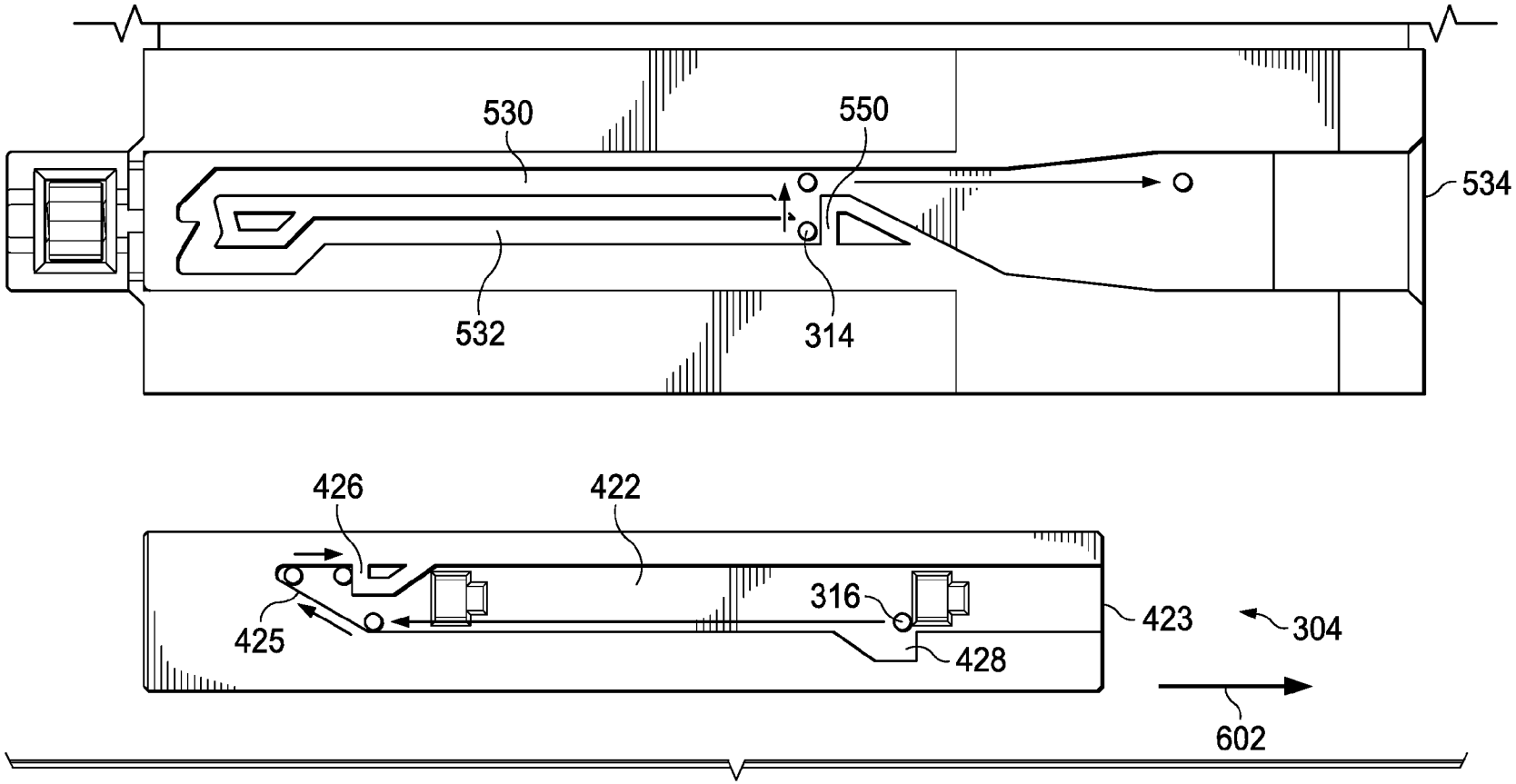
FIG. 6D is a plan view of pin movement through a set of push-to-open channels and a guide block of a preferred embodiment during an opening movement.

As shown in FIG. 6D, continued application of a user supplied force in opening direction 602 moves soft close track 304 with the drawer and because end 314 is in contact with catch 550, carriage 306 slides along soft close track 304 away from cap 310. Soft close springs 323 and 324 are loaded with soft close force 332 as the drawer moves in opening direction 602. End 316 contacts redirecting surface 425 which causes cylindrical step 313 and pin 315 to move to end 442 of oblong hole 440 while simultaneously moving end 314 out of engagement with catch 550 and into inlet channel 530. Soft close force 332 urges end 316 into contact with catch 426. Continued movement of the drawer and soft close track 304 in opening direction 602 moves end 314 out of inlet channel 530, past catch 550, and out of opening 534 such that the drawer can be moved to a completely open position.

Figure 7:
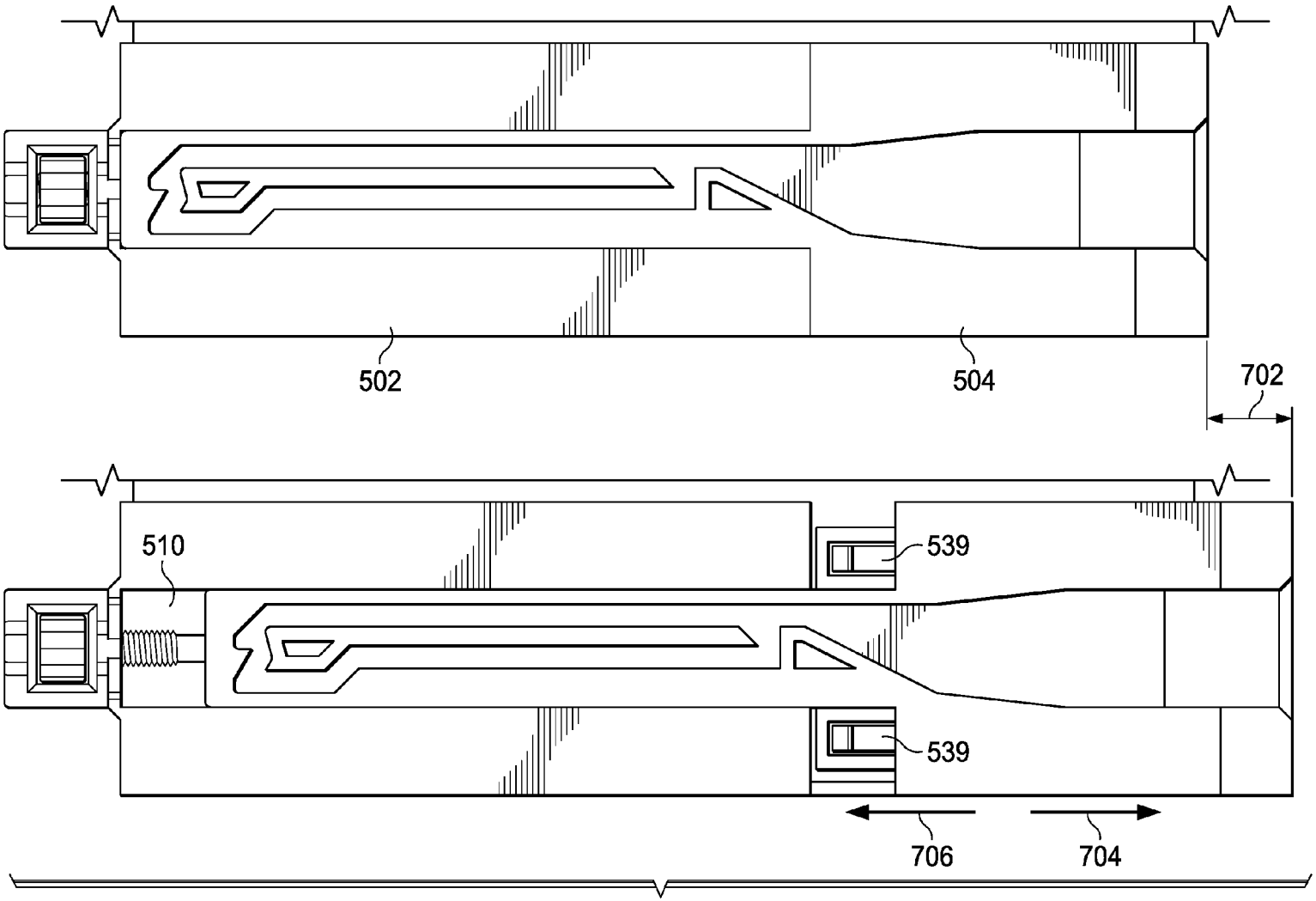
FIG. 7 is a plan view of a guide block of a preferred embodiment showing a depth adjustment.

Referring to FIG. 7, the position of movable portion 504 is adjustable with respect to stationary part 502. Adjusting the position of movable portion 504, adjusts the contact point of protrusion 462 with abutment 554 which adjusts the depth of the drawer relative to the cabinet carcass. To adjust the depth of the drawer, thumbwheel 518 is rotated. Rotation of thumbwheel 518 causes threaded shaft 552 to advance or retreat through thumbwheel 552 thus adjusting the position of movable portion 504 with respect to stationary part 502. Rotation of thumbwheel 518 in a first direction causes movable portion 504 to move in direction 704 while rotation of thumbwheel 518 in a second direction causes movable portion 504 to move in direction 706. Movable portion 504 can move distance 702, generally equal to the length of threaded shaft 552. Spring tabs 539 engaged with slots on segments 506 and 508 at end 522 of stationary part 502 limit movement of movable portion 504 in direction 704. Adjusting the position of movable portion 504 on both sides of the drawer provides synchronization of the two drawer side assemblies attached to the drawer and aligns the drawer within the cabinet carcass. The alignment of the two drawer slide assemblies ensures unencumbered, coordinated movement of the drawer slide assemblies which prevents jamming.

It will be appreciated by those skilled in the art that changes could be made to the embodiments described above without departing from the broad inventive concept. It is understood, therefore, that this disclosure is not limited to the particular embodiments herein, but it is intended to cover modifications within the spirit and scope of the present disclosure as defined by the appended claims.

The invention claimed is:

1. A push-to-open, soft close drawer slide apparatus for a drawer slide assembly, the apparatus comprising:

a housing mounted to a first rail of the drawer slide assembly;

a guide block mounted to a second rail of the drawer slide assembly;

an ejector slidably mounted to the housing and configured to abut the guide block;

a carriage slidably mounted to the housing and slidable in a generally longitudinal direction along the housing;

a damper supported by the housing and connected to the carriage;

a soft close bias member connected to the housing and the carriage;

an ejector bias member connected to the housing and the ejector;

a pin, slidable in a generally lateral direction within the carriage, having a first end extending from the carriage and a second end extending from the carriage; and, the first end slidingly engaged with a groove in the housing and the second end slidingly engaged with the guide block.

2. The push-to-open, soft close drawer slide apparatus of claim 1 wherein the guide block further comprises:

a stationary part mounted to the second rail of the drawer slide assembly;

a movable part slidably engaged with the stationary part and defining a first drawer position;

a threaded shaft extending from the movable part;

a thumbwheel contained within the stationary part and threadably engaged with the threaded shaft; and, wherein rotation of the thumbwheel adjusts the first drawer position to a second drawer position.

3. The push-to-open, soft close drawer slide apparatus of claim 1 wherein the guide block further comprises:

an inlet channel leading to a first redirecting surface;

a second redirecting surface leading to an outlet channel;

a first catch positioned between the first redirecting surface and the second redirecting surface; and, the outlet channel leading to a second catch and the inlet channel.

4. The push-to-open, soft close drawer slide apparatus of claim 1 wherein the housing further comprises:

a base mounted to the first rail of the drawer slide assembly;

a soft close track attached to the base and defining a soft close catch and a recess;

the first end releasably engaged with the soft close track and the recess;

the soft close bias member providing a soft close force;

the ejector bias member providing an ejector force; and, wherein the soft close force is greater than the ejector force.

5. The push-to-open, soft close drawer slide apparatus of claim 1 wherein the carriage further comprises:

an oblong hole having a latitudinal axis generally perpendicular to the direction of travel of the drawer slide assembly;

a dog slidable within the carriage;

a step extending from the dog and slidably engaged with the oblong hole; and, the soft close bias member providing a bias between the carriage and the housing.

6. The push-to-open, soft close drawer slide apparatus of claim 1 wherein:

the housing further comprises a base having a set of ridges;

a soft close track attached to the base and defining the groove;

a soft close catch and a recess formed in the groove;

the carriage slidably engaged with the soft close track; and, the ejector slidingly engaged with the set of ridges.

7. The push-to-open, soft close drawer slide apparatus of claim 1 wherein:

the guide block further comprises a stationary part adjustably engaged with a movable part;

the movable part defines an inlet channel separated from an outlet channel by an island, wherein the island defines a first catch;

the inlet channel leads to a first redirecting surface;

the outlet channel leads to a second catch; and, a threaded shaft extends from the movable part and engages a thumbwheel seated in the stationary part.

* * * * *